US005946720A

United States Patent [19]

Sauriol

[11] Patent Number: 5,946,720

[45] Date of Patent: Sep. 7, 1999

[54] PROTECTIVE GLOVE WITH ERGONOMICS FEATURES

[75] Inventor: Claude Sauriol, Laval, Canada

[73] Assignee: Bauer, Inc., Canada

[21] Appl. No.: 08/891,836

[22] Filed: Jul. 14, 1997

[51] Int. Cl.[6] ..... A41D 13/10

[52] U.S. Cl. ..... 2/16; 2/161.1

[58] Field of Search ..... 2/16, 20, 159, 2/161.1, 163

[56] References Cited

U.S. PATENT DOCUMENTS

| | | | |
|---|---|---|---|
| 1,841,193 | 1/1932 | Lidston | 2/16 |
| 4,484,359 | 11/1984 | Tirinen | 2/161.1 |
| 4,497,073 | 2/1985 | Deutsch | 2/16 |
| 4,570,269 | 2/1986 | Berlese | 2/16 |
| 4,663,783 | 5/1987 | Obayashi | 2/161.1 |
| 4,677,698 | 7/1987 | Angas | 2/16 |
| 4,815,147 | 3/1989 | Gazzano et al. . | |
| 5,237,703 | 8/1993 | Brine et al. | 2/16 |
| 5,488,739 | 2/1996 | Cardinal . | |
| 5,511,243 | 4/1996 | Hall et al. . | |
| 5,787,506 | 8/1998 | Wilder et al. | 2/161.1 |

*Primary Examiner*—Michael A. Neas

*Attorney, Agent, or Firm*—Finnegan, Henderson, Farabow, Garrett & Dunner, LLP

[57] ABSTRACT

The invention relates to a protective glove comprising ergonomic features. The finger receiving portions of the glove of the present invention have at least two flexion zones that preferably correspond to the joints of the fingers thereby increasing the flexibility of the glove at that area and improving stick control. In another aspect, the glove has four finger sheaths that are adapted to receive the fingers of the player and that are bend toward the palm side of the glove, the bending of these finger receiving portions increasing from the index finger to the little finger. The protective glove of the invention is particularly useful for hockey players.

12 Claims, 3 Drawing Sheets

PROTECTIVE GLOVE WITH ERGONOMICS FEATURES

FIELD OF THE INVENTION

The present invention relates to the field of protective equipment for use in sporting activities. More particularly, the invention relates to a glove, such as a hockey glove, with finger portions that adapt to the anatomy of the player's hand and the natural position taken by the hand during play.

BACKGROUND TO THE INVENTION

During the past few years, protective equipment manufacturers have attempted designing ice hockey gloves that offer a reduced resistance to the natural movement to which the hand is subjected when handling various objects, such as hockey sticks.

U.S. Pat. No. 4,815,147 issued on Mar. 28, 1989 and naming Gazzano et al. as inventors, U.S. Pat. No. 5,488,739 issued on Feb. 6, 1996 and naming Cardinal as an inventor and in U.S. Pat. No. 5,511,243 issued on Apr. 30, 1996 and naming Hall et al. as inventors offer examples of attempts to design ergonomic hockey gloves. The contents of those documents are incorporated herein by reference. These designs, however, require a modification of the dorsal portion of the glove, i.e. the portion of the glove, opposite the palm that extends from the base of the fingers to the wrist. To increase the flexibility of the glove, fold lines on ribs are formed into that particular region of the glove. The provision of such flexibility enhancing structures is accomplished by locally reducing the amount of padding. That, however, can significantly weaken the protective covering the glove provides over the dorsal portion of the hand. The lessened protective behaviour in that area is a serious disadvantage since the dorsal portion of the hand is exposed and is often subjected to impact during a hockey game.

Another disadvantage of such prior art is that the sheaths of these gloves poorly fit the anatomy of the player. Indeed, the finger sheaths typically comprise a single joint near the articulation between the proximal phalanx and the middle phalanx. This reduces the amount of control the player can exercise over the hockey stick.

The prior art also fails to teach a protective glove having a finger sheaths designed to accommodate the natural position of the hand that is holding a hockey stick.

Thus, there is a need for a protective hockey glove which allows for a better stick handling and is more comfortable without unduly restricting the protection over the dorsal area of the hand. There is also a need in the industry to provide a protective glove with anatomically correct finger sheaths.

OBJECTS AND STATEMENT OF THE INVENTION

It is therefore an object of the present invention to provide a protective glove with anatomically correct finger sheaths.

It is a further object of the invention to provide a protective glove with finger sheaths capable of collectively adapting to the natural position of a hand that is holding a hockey stick.

As embodied and broadly described herein, the invention provides a protective sporting glove comprising a hand receiving portion having a palm side and a dorsal side, the hand receiving portion including a plurality of fingers sheaths for receiving and enclosing fingers of a hand placed in said glove, the finger sheaths enclosing respective fingers of the hand from an area proximate the base of the finger to the end of the finger, the hand receiving portion also comprising a thumb sheath for receiving and enclosing a thumb of the hand, the thumb sheath enclosing the thumb from an area proximate the base of the thumb to the end of the thumb, each finger sheath comprising on the dorsal side and an inner side generally opposite said dorsal side, an elongated protective padding element extending along the finger sheath, said elongated protective padding element being located on said dorsal side, said elongated protective padding element including first, second and third segments, and a pair of flexion zones in a spaced apart relationship over said finger sheath, each said flexion zone being located between a pair of adjacent segments, said flexion zones allowing said first, second and third segments to bend one with relation to the others.

In a preferred embodiment, the hand receiving portion comprises four finger sheaths adapted to respectively receive and enclose the index finger, middle finger, third finger and little finger of the hand, each finger sheath comprising a protective pad comprising a first flexion zone and a second flexion zone, the first and second flexion zones allowing the player to bend his fingers at these zones. Most preferably, the first flexion zone is located near the joint area between the proximal phalanx and the middle phalanx and the second flexion zone is located near the joint area between the middle phalanx and the distal phalanx. The first and second flexion zones separate the protective pad into three distinct segments and a preferential bend toward the palm side is built into the structure to better fit the normal posture of the finger.

In another preferred embodiment, the degree of pre-built bending of the finger sheath that receives the little finger of the player is greater than the degree of pre-built bending of the finger sheath holding the third finger of the player, which is itself greater than the bending of the finger sheath receiving the middle finger of the player which is itself greater than the degree of pre-built bending of the finger sheath holding the index finger. Such consecutive increase is the degree of pre-built bending from the finger sheath holding the index toward the finger sheath holding the little finger creates a structure that closely follows the posture adopted normally by a human hand when loosely holding an elongated object, such as a hockey stick. To solidly grip the stick, it suffices to further bend the finger sheaths. In other words, the differential in pre-built bending between the finger sheaths creates a more natural pre-disposition to grip a stick. Thus, the degree of further bending required to achieve a condition of solid grip is less than in a structure where no differential in the degree of the pre-built bending exists between the finger sheaths.

In a preferred embodiment, the flexion zones are created by segmenting, at selected areas, the protective pads located on the dorsal side of the finger sheaths. The resulting glove thus comprises a plurality of finger sheaths, each having a protective pad separated into distinct segments angularly moveable relative one another in the plane in which the finger received in the sheath curls. In comparison with prior art devices, the resulting glove, according to the invention, offers increased flexibility and mobility which results in maximum stick control. The person skilled in the art will, however, realize that such flexibility increase at selected areas (corresponding generally to the joint area between the proximal phalanx and the middle phalanx and to the joint area between the middle phalanx and the distal phalanx of the player's hand) may be achieved otherwise. For example, there may be provided a glove in which the protective pads are made of a material that may stretch at localized areas thereby allowing the player to bend his fingers at sites corresponding generally to the finger joints. The finger sheaths may also be provided with any type hinge or hinge-like device that will permit the protective pad to flex at the desired area. In summary, the expression "flexion zone" as it appears in the present specification should not be considered to necessarily imply a physical discontinuity, separation or lack of structural cohesion between the segments of the protective pad elements. Rather, this expression simply designates a zone in the protective pad element, that will locally bend on flex when the pad element is caused to assume a curved shape. Such zone can be a discontinuity in the protective pad element, a zone having a higher flexibility or extensibility than the adjacent parts of the pad element, a mechanical hinge device or any other structure that would behave in such manner.

As embodied and broadly described herein, the invention also provides a protective glove comprising a hand receiving portion having a palm side and a dorsal side, the hand receiving portion comprising four sheaths adapted to respectively receive and enclose an index finger of a hand inserted in the glove, middle finger of the hand, third finger of the hand and little finger of the hand, each finger sheaths enclosing an area proximate the base of the respective finger to the end of the respective finger, the hand receiving portion also comprising a thumb sheath for receiving a thumb of the hand, the thumb receiving portion enclosing the thumb from an area proximate the base of the thumb to the end of the thumb, each finger sheath having a protective pad element in a condition of curl toward the palm side, said condition of curl being maintained in the absence of a finger in each said finger sheath, said pad element comprising a pair of segments and a flexion zone between said segments, said segments being capable of moving angularly apart from one another at said flexion zone under efforts tending to augment a degree of curl of said finger sheath, said finger sheaths manifesting a differential degree of curling one with relation to the other, said differential in the degree of curling being maintained in the absence of a hand in said glove.

In a most preferred embodiment, the degree of curl progressively increases from the finger sheath holding the index finger toward the finger sheath holding the little finger. In other words, the little finger sheath is the most curled, while the index finger sheath manifests the least degree of curling or bending. For clarity, note that by "condition of curl" is meant curling or bending in the plane in which a finger normally curls when moving toward the palm of the hand.

As embodied and broadly described herein, the invention also comprises a protective sporting glove comprising a hand receiving portion having a palm side and a dorsal side, the hand receiving portion including a plurality of fingers sheaths for receiving and enclosing fingers of a hand placed in the glove, the finger sheaths enclosing respective fingers of the hand from an area proximate the base of the finger to the end of the finger, the hand receiving portion also comprising a thumb sheath for receiving and enclosing a thumb of the hand, the thumb sheath enclosing the thumb from an area proximate the base of the thumb to the end of the thumb, each the finger sheath comprising on the dorsal side and on an inner side generally opposite the dorsal side, an elongated protective padding element extending along the finger sheath, the elongated protective padding element being located on the dorsal side, the elongated protective padding element including first, second and third segments, and a pair of flexion zones in a spaced apart relationship over the finger sheaths, each the flexion zone being located between a pair of adjacent segments, the flexion zones allowing the first, second and third segments to bend one with relation to the others, wherein the longitudinal dimension of the dorsal sides of each the first, second and third segments exceeds the longitudinal dimension of their respective inner sides.

Preferably, the thumb sheaths of the glove of the invention comprises a protective pad and a flexion zone that allows the player to bend his thumb at that area.

Other objects and features of the invention will become apparent by reference to the following specification and to the drawings.

BRIEF DESCRIPTION OF THE DRAWINGS

The following is a description by way of a preferred embodiment, reference being made to the following drawings, in which.

DESCRIPTION OF A PREFERRED EMBODIMENT

Figure 1:
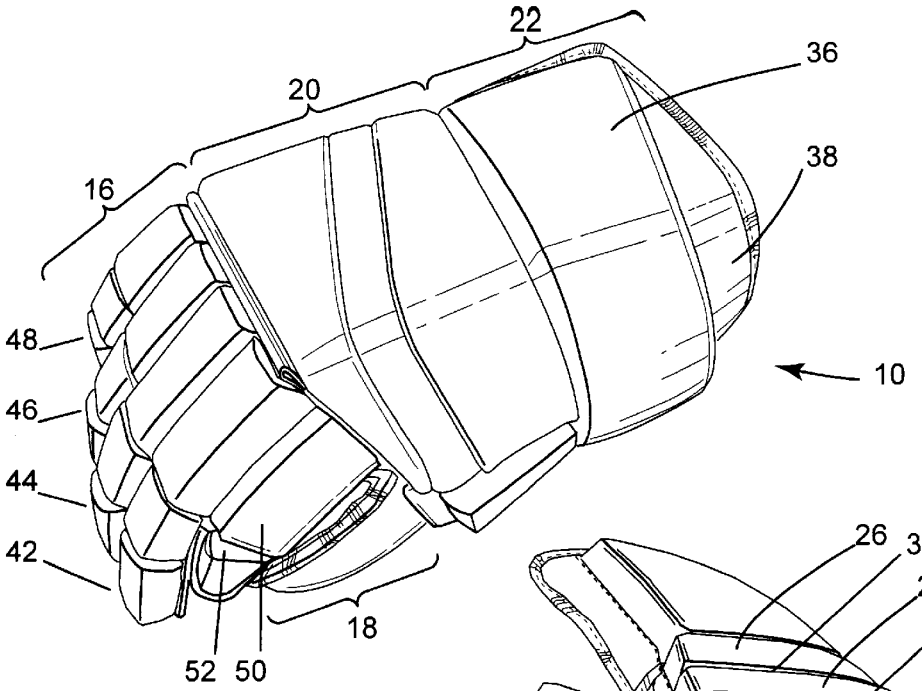
FIG. 1 and 2 are perspective views of a protective glove for a right hand made in accordance with the invention.
Figure 2:
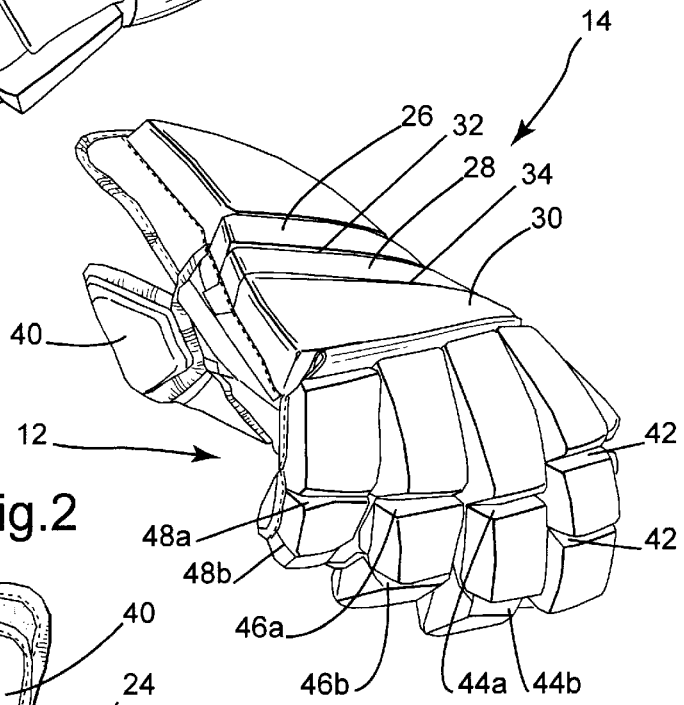

Referring now to FIGS. 1 and 2, there is shown a protective glove 10 comprising a hand receiving portion having a palm side 12 and a dorsal side 14. The hand receiving portion comprises a finger receiving portion 16 which extends generally from the base of the fingers of a player to the end of these fingers, a thumb sheath 18 which extends generally from the base of the thumb of the player to the end of this thumb and also comprises a dorsal portion 20 which extends generally from the base of the fingers and thumb of the player to the wrist. The protective glove further comprises a cuff portion 22 which extends from the wrist up towards the lower forearm of the player, the cuff portion being secured to the hand receiving portion of the glove.

On the palm side, the hand receiving portion is made of a suitable flexible material 24 such as soft leather or leather-like materials. An example of a suitable material is commercialize under the name CLARINO (trade-mark of Kuraray Co. Ltd.). The palm may also be treated with silicone to improve stick control and may further be reinforced with a protective layer of aramid material such as KEVLAR (trade-mark of E.I. Du Pont de Nemours and Company).

The dorsal side of the hand receiving portion is made of a flexible web-like material to which is attached a plurality of protective pad segments. The dorsal side of the finger sheaths forming the fingers receiving portion, thumb sheath and dorsal portion and the cuff portion therefore comprise a plurality of protective pad elements which are made of materials conventionally found in the prior art. Examples of such materials include polyethylene inserts and may include various composite materials designed to absorb the energy of an impact. The protective pads include an outer abrasion resistant covering such as leather, knit polyester and PVC or other materials conventionally found in the prior art. The shape and location of the protective pad elements will be described in more details hereinafter.

Figure 7:
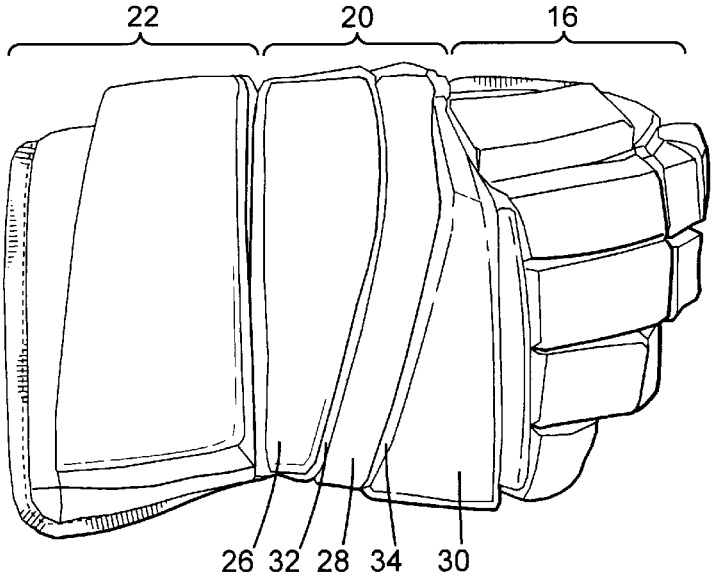
FIG. 7 is a top plan view of a protective glove made in accordance with the invention.

As shown more particularly in FIG. 7, the dorsal portion 20 of the glove may be provided with a plurality of protecting pad elements 26, 28 and 30 separated by flexion zones 32 and 34 that facilitate the natural flexion of the hand when the player is holding his hockey stick. While the preferred glove is described as having three protective pads 26, 28 and 30 and two flexion zones 32 and 34, it will become apparent to the person skilled in the art that a variety of other patterns of protective elements/flexion zones may be used. Examples of possible embodiments for the dorsal portion of the glove are found in U.S. Pat. No. 4,815,147, U.S. Pat. No. 5,488,739 and in U.S. Pat. No. 5,511,243 referred to above. The contents of those references are incorporated by reference.

Referring back to FIG. 1, the cuff portion 22 of the glove comprises a cuff protector 36 that surrounds the wrist of the user. A padded area 38 extends beyond the cuff protector towards the lower forearm of the player to enhance the level of protection of forearm.

To provide full protection while allowing for maximum flexibility of the wrist, the cuff portion has a padded attachment 40 that is moveable relative to the cuff protector 36. In order to ensure that the glove will not easily slide off the player's hand, there may also be provided a flexible attachment (not shown) made of a suitable high friction material such as neoprene. This attachment will enclose the hand within the glove while allowing a full range of motion at the wrist.

As shown in more details in FIGS. 1 and 2, the hand receiving portion comprises four finger sheaths 42, 44, 46 and 48 adapted to enclose the index finger, middle finger, third finger and little finger of the player. Each finger sheath comprises a protective pad element including three distinct segments separated from one another by first flexion zones 42*a*, 44*a*, 46*a* and 48*a* and second flexion zones 42*b*, 44*b*, 46*b* and 48*b* that allow the player to curl his fingers.

An elongated protective section 50 is located adjacent the index finger and extends generally from the base of the index finger to approximately the beginning of the distal phalanx of the index finger. The protective section 50 comprises protective padding and a flexion zone 52 that corresponds preferably to the joint between the proximal phalanx and the middle phalanx of the player's index finger thereby protecting the side portion of that finger while allowing the user to bend it.

The thumb portion 18 also comprises protective pad segments 54' and 54" and a flexion zone 56 that allows the player to bend his thumb.

Figure 5:
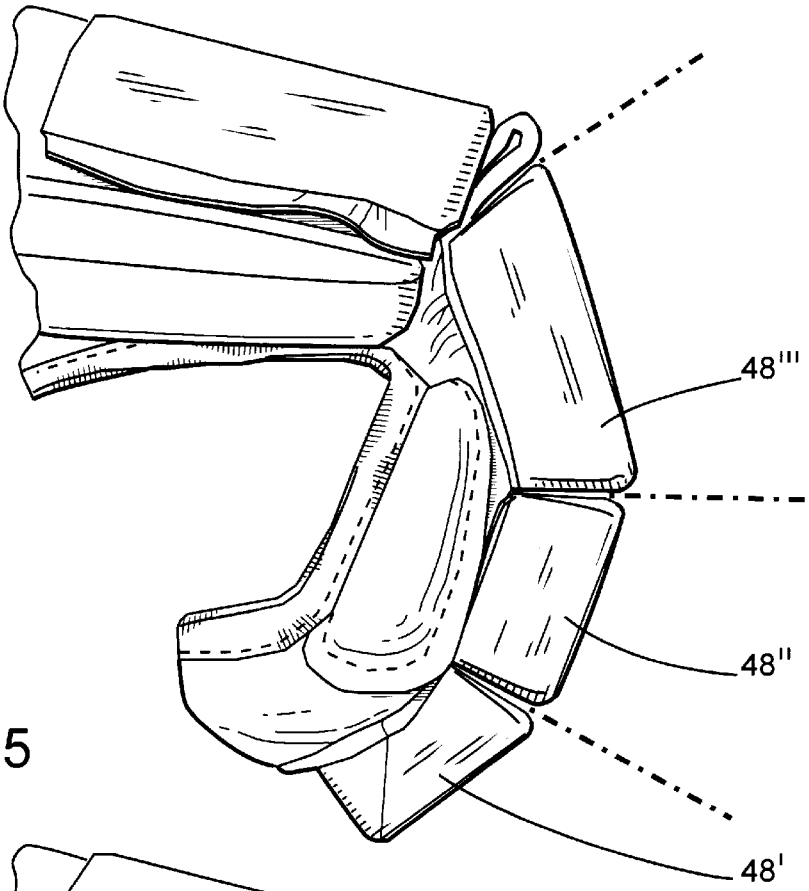
FIG. 5 is a right side view illustrating the protective pad segments of the little finger sheath at rest.
Figure 6:
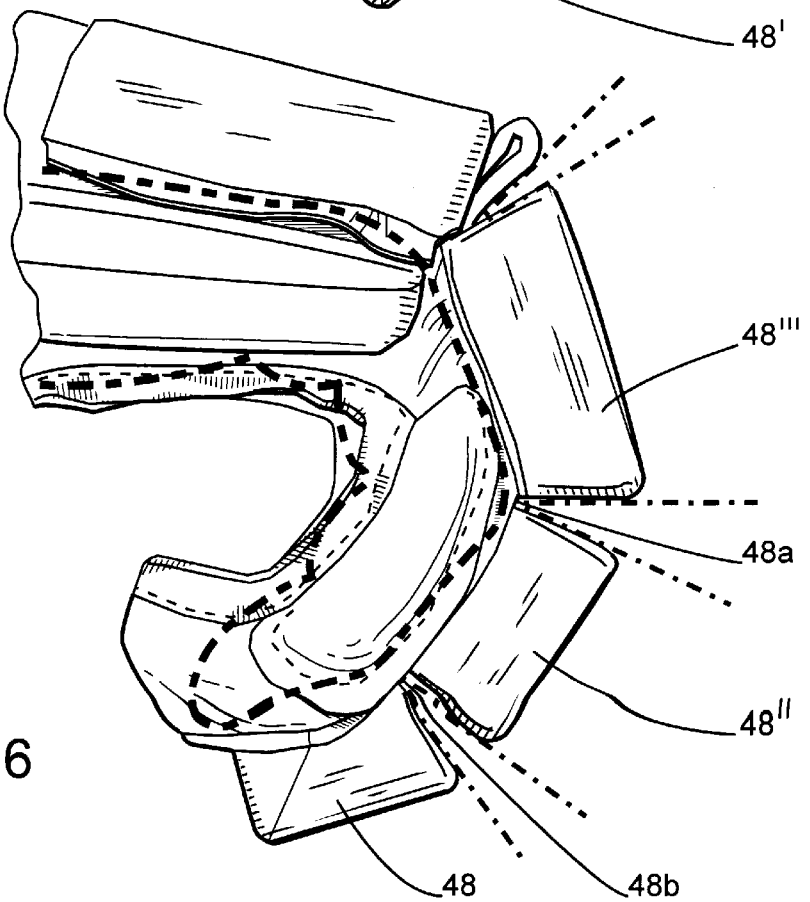
FIG. 6 is a right side view illustrating the protective pad segments of the finger sheath of the protective glove when the little finger of the player is bent.

As shown more particularly in FIGS. 5 and 6, the glove of the present invention has the advantage of providing a finger receiving portion comprising at least two flexion zones that allow the player to bend his fingers at anatomically correct areas. The first flexion zones 42*a*, 44*a*, 46*a* and 48*a* (the latter one being shown in FIGS. 5 and 6) preferably are near the articulation area between the proximal phalanx and the middle phalanx of the player while the second flexion zones 42*b*, 44*b*, 46*b* and 48*b* (the latter one being shown in FIGS. 5 and 6) preferably are near the articulation area between the middle phalanx and the distal phalanx of the player's hand thereby separating the protective pad 48 into three distinct segments, such as segments 48', 48" and 48'".

This particular configuration has the advantage of accommodating the natural position of the hand that is holding a hockey stick thereby allowing for better stick handling without unduly restricting the protection of the dorsal area of the hand. Since not all the fingers of the hand are of the same length, the invention also allows the provision of a protective glove which is designed in conformity with the anatomy of each of the player's fingers.

Figure 3:
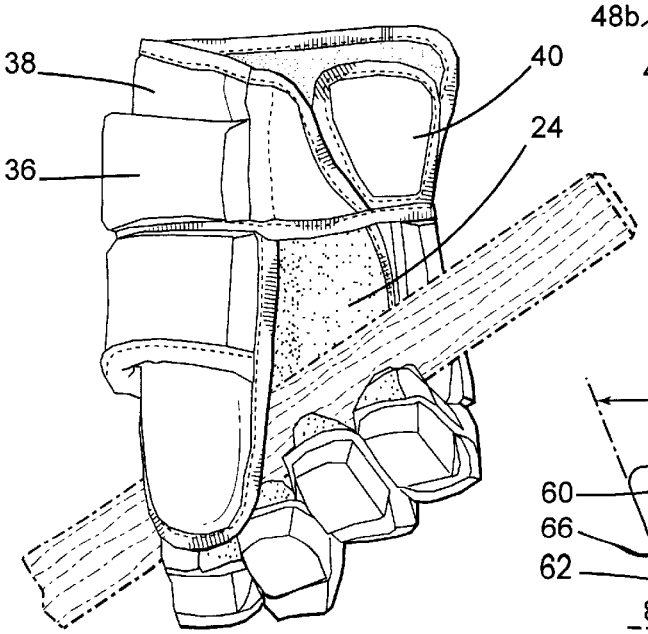
FIG. 3 is a bottom plan view of the protective glove of FIGS. 1 and 2 holding a hockey stick.
Figure 8:
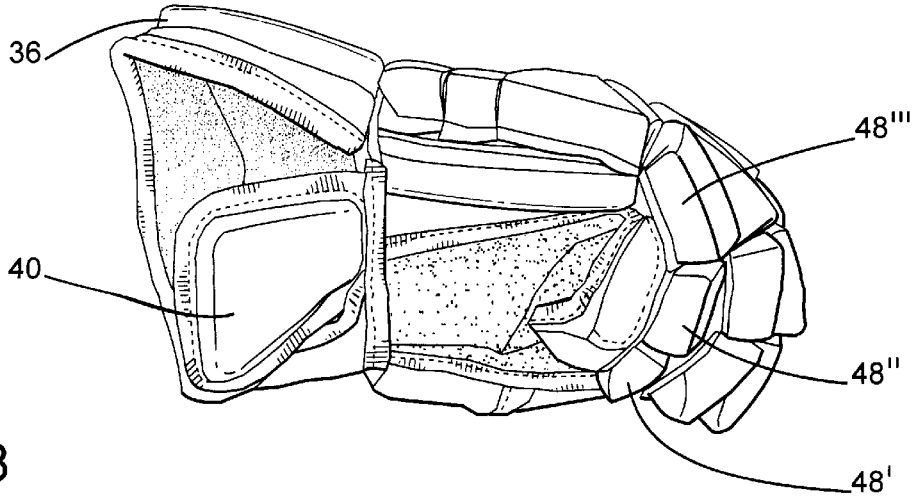
FIG. 8 is a side elevational view of a protective glove made in accordance with the invention.

As shown more particularly in FIGS. 2 and 8, in the preferred embodiment, the finger sheaths are curled or bend toward the palm side. Most preferably, the bending of finger sheath 48 is greater than the bending of the finger sheath 46 which is itself greater than the bending of finger sheath 44 which is again greater than the bending of finger sheath 42. This allows the glove to accommodate the position naturally assumed by the hand of the player when holding his stick, as shown more particularly in FIG. 3.

The provision of finger sheaths that are curled towards the palm side also has the advantage of better protecting the joints of the player's fingers. FIG. 5 illustrates the little finger receiving portion and in an "at rest" position, i.e. while the hand is being removed from the glove. As shown in that drawing, the adjacent end walls of segments 48', 48" and 48'" are angled relative one another in such a way that the finger sheath 48 is bend toward the palm side of the glove. When the glove is in an "at rest" position (as shown in FIG. 5), the joints of the player's fingers are thus fully protected. When the player bends his fingers to grasp his hockey stick (as shown in FIG. 6), the joints become slightly exposed at the flexion zones 48*a* and 48*b*. In contrast with the glove of the prior art, where each segment of protective pad is of generally rectangular cross-section, the glove of the present invention has the advantage of reducing considerably the size of the opening at the joint area created by the bending of the fingers.

Figure 9:
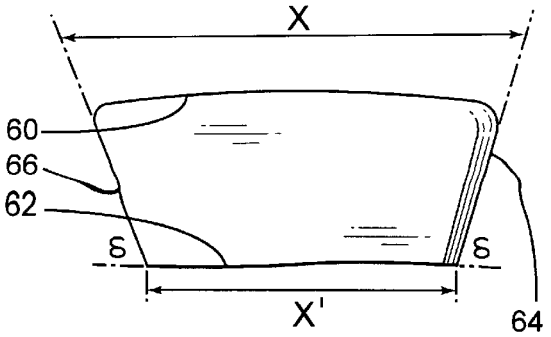
FIG. 9 is a side elevational view of a protective pad segment illustrating the angled end walls.
Figure 4:
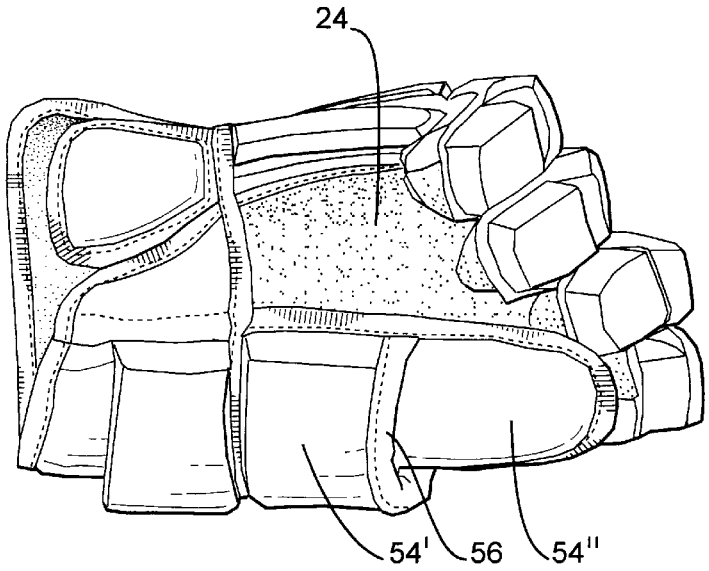
FIG. 4 is a bottom plan view of the protective glove.

As shown more particularly in FIG. 9, the condition of curl is obtained by providing segments in which the longitudinal dimension x of the dorsal side 60 exceeds the longitudinal dimension x' of the inner side thereof 62. This provides a segment wherein the end walls 64 and 66 are angled outwardly, i.e. the angle θ is less than 90 degrees.

While it is in theory possible to completely eliminate the exposure of the joint area by always maintaining the glove in a closed position (i.e. by modifying the angles θ of the end walls of any of the segments, such as segments 48', 48" and 48'"), this would have the disadvantage of limiting the flexibility of the glove and prevent the player to open his hand to catch a puck or other object.

Although not illustrated in the drawing, the interior of the protective glove may be provided with a lining to keep the hand cool and dry. A suitable lining may be made of a material commercialized under the trade-mark COOLMAX (trade-mark of E.I. Du Pont de Nemours and Company).

Throughout this specification, the preferred embodiment is described using a player of masculine gender in order to simplify the description. The masculine gender should however be interpreted as including both sexes.

The above description of a preferred embodiment should not be interpreted in any limiting manner since variations and refinements are possible which are within the spirit and scope of the present invention. The scope of the invention is defined in the appended claims and their equivalents.

The embodiments of the invention for which an exclusive property or privilege is claimed are defined as follows:

1. A protective sporting glove comprising a hand receiving portion having a palm side and a dorsal side, said hand receiving portion including a plurality of finger sheaths for receiving and enclosing fingers of a hand placed in said glove, said finger sheaths enclosing respective fingers of the hand from an area proximate the base of the finger to the end of the finger, said hand receiving portion also comprising a thumb sheath for receiving and enclosing a thumb of the hand, said thumb sheath enclosing the thumb from an area proximate the base of the thumb to the end of the thumb, each said finger sheath comprising a dorsal side, an inner side and an elongated protective padding element extending along the finger sheath, said elongated protective padding element being located on said dorsal side, said elongated protective padding element including first, second and third segments, and a pair of flexion zones in a spaced apart relationship over said finger sheath, each said flexion zone being located between a pair of adjacent segments, said flexion zones allowing said first, second and third segments to bend one with relation to the others, wherein the longitudinal dimension of the dorsal side of at least one of the first, second and third segments exceeds the longitudinal dimension of its inner side.

2. The protective sporting glove as defined in claim 1, wherein the differential longitudinal dimensions between said dorsal side and said inner side of at least one of said segment of protective padding induces a condition of curl toward the palm side of said glove to each said finger sheath.

3. The protective sporting glove as defined in claim 2, wherein the degree of curl of each finger sheath progressively increases from the finger sheath receiving the index finger to the finger sheath receiving the little finger.

4. The protective sporting glove as defined in claim 3, wherein said degree of curl of each finger sheath is maintained in the absence of the hand in said glove.

5. The protective sporting glove as defined in claim 4, wherein said degree of curl of each finger sheath is predetermined to shape said glove so that said glove generally conforms to the contours of a stick in the absence of the hand in said glove.

6. The protective sporting glove as defined in claim 1, wherein said flexion zone is defined by the space between two adjacent segments of protective padding on each finger sheath.

7. A protective sporting glove comprising a hand receiving portion having a palm side and a dorsal side, said hand receiving portion including a plurality of finger sheaths for receiving and enclosing fingers of a hand placed in said glove, said finger sheaths enclosing respective fingers of the hand from an area proximate the base of the finger to the end of the finger, said hand receiving portion also comprising a thumb sheath for receiving and enclosing a thumb of the hand, said thumb sheath enclosing the thumb from an area proximate the base of the thumb to the end of the thumb, each said finger sheath comprising a dorsal side, an inner side and an elongated protective padding element extending along the finger sheath, said elongated protective padding element being located on said dorsal side, said elongated protective padding element including first and second segments, and a flexion zone located between the first and second segments, said flexion zone allowing said first and second segments to bend one with relation to the other, wherein the longitudinal dimension of the dorsal side of at least one of the first and second segments exceeds the longitudinal dimension of its inner side.

8. The protective sporting glove as defined in claim 7, wherein the differential longitudinal dimensions between said dorsal side and said inner side of at least one of said segment of protective padding induces a condition of curl toward the palm side of said glove to each said finger sheath.

9. The protective sporting glove as defined in claim 8, wherein the degree of curl of each finger sheath progressively increases from the finger sheath receiving the index finger to the finger sheath receiving the little finger.

10. The protective sporting glove as defined in claim 9, wherein said degree of curl of each finger sheath is maintained in the absence of the hand in said glove.

11. The protective sporting glove as defined in claim 10, wherein said degree of curl of each finger sheath is predetermined to shape said glove so that said glove generally conforms to the contours of a stick in the absence of the hand in said glove.

12. The protective sporting glove as defined in claim 7, wherein said flexion zone is defined by the space between said first and second segments of protective padding on each finger sheath.

* * * * *